United States Patent [19]

Korn

[11] Patent Number: 4,461,389

[45] Date of Patent: Jul. 24, 1984

[54] TAMPER-PROOF CLOSURE AND CONTAINER ARRANGEMENT

[75] Inventor: Peter Korn, Del Mar, Calif.

[73] Assignee: Maxwell Laboratories, Inc., San Diego, Calif.

[21] Appl. No.: 438,602

[22] Filed: Nov. 2, 1982

[51] Int. Cl.[3] ..... B65D 41/54

[52] U.S. Cl. ..... 215/246; 215/230; 215/250; 206/459

[58] Field of Search ..... 215/203, 220, 230, 246, 215/250, 351, 365, 252; 206/459, 534

[56] References Cited

U.S. PATENT DOCUMENTS

| | | | |
|---|---|---|---|
| 2,068,389 | 1/1937 | Smith | 215/350 |
| 2,390,561 | 12/1945 | Staples | 215/343 |
| 2,706,464 | 4/1955 | North | 206/459 |
| 3,088,830 | 5/1963 | Graham | 215/365 |
| 3,489,307 | 1/1970 | Wenger | 215/351 |
| 3,640,417 | 2/1972 | Sakurai | 215/246 |
| 3,873,018 | 3/1975 | Donnay | 215/246 |
| 3,977,554 | 8/1976 | Costa | 215/220 |
| 4,069,935 | 1/1978 | Hampel | 215/220 |

*Primary Examiner*—Joseph Man-Fu Moy
*Assistant Examiner*—David Fidei
*Attorney, Agent, or Firm*—Fitch, Even, Tabin & Flannery

[57] ABSTRACT

A tamper-proof closure arrangement for a container includes a shrinkable seal applied to seal receiving surfaces of the container and closure cap such that the seal is applied internally of the closure cap without removing the closure cap. In a preferred embodiment, the seal surfaces comprise three-dimensional surfaces formed on the container neck and on the closure cap internally of a skirt portion of the cap. The seal is visible through the closure cap such that any attempt at removing the cap irreversibly damages or deforms the seal to provide a visual indication of tampering.

9 Claims, 5 Drawing Figures

TAMPER-PROOF CLOSURE AND CONTAINER ARRANGEMENT

BACKGROUND OF THE INVENTION

The present invention relates generally to tamper-proof closures, and more particularly to a novel visible tamper-proof closure and container arrangement wherein a seal is applied to surfaces internally of an already closed container in a manner such that any tampering with the closure cap causes irreparable damage to the seal which is visually observable through the closure cap.

The emphasis on public safety in recent years, and particularly as it relates to commercial products which are ingested by human beings, has led to the development of various types of containers and closure caps which are termed "tamper-proof". Tamper-proof containers and closures include both containers which have membrane or thin foil-like seals secured as by an adhesive about the periphery of the container neck so as to cover the access opening, and closure caps which are constructed to prevent removal of the closures from associated containers without causing some visual indication that the closure has been removed or otherwise tampered with. This is of particular concern with containers used for ingestible commercially available products so that the purchaser can feel reasonably safe that the purchased goods are unadulterated. The development of tamper-proof containers and closures has resulted from both voluntary private innovation and as a result of legislation passed to insure minimum standards of safety.

A significant drawback of tamper-proof seals of the type wherein a membrane or foil-like seal is placed on the neck of the container so as to overlie the access opening is that while the seal is generally broken by the purchaser to provide access to the contents of the container, it does not take a high degree of skill to at least partially remove the seal for access to the container followed by reattachment of the seal in a manner undetectable by the average consumer. The ability of such a seal to provide a substantially foolproof indication to the consumer that the contents of the container have not been tampered with are thus quite minimal.

One type of closure arrangement which has become quite prevalent in the packaging of consumer products and particularly in the packaging of dairy products such as milk, utilizes a closure cap having a breakaway tamper-proof ring attached therewith through one or more frangible connector elements such that removal of the primary cap generally causes it to be severed from the ring or otherwise fractures the ring so as to provide a visual indication that the primary closure cap has been removed. While this type of tamper-proof closure cap has proven generally successful for its intended purpose, it does not absolutely prevent removal and reapplication by a skilled technician without severing the frangible connections between the closure cap and the tamper-proof ring. Moreover, one having access to the proper equipment can readily remove such a tamper-proof closure even though destroying it in the process, and reapply a closure in similar fashion to the original manufacturer or processor. A significant need thus exists for a tamper-proof closure arrangement wherein the primary closure cap cannot be manipulated or removed in any manner without irreparably damaging a visually observable seal and wherein the seal is applied in a manner which prevents reapplication of a seal by one without a high degree of skill and specialized equipment.

SUMMARY OF THE INVENTION

In accordance with the present invention a novel visible tamper-proof closure arrangement is provided wherein a seal is formed against selected seal receiving surfaces on a closure cap and container after the closure cap has been applied to the container such that any movement of the closure cap relative to the container causes irreparable damage to the seal visible through the closure cap. In the preferred embodiment, a closure cap and neck portion of the container are mutually cooperable to enable placement of a shrinkable ring-like seal member onto the container neck so that the seal is disposed internally of a skirt on the cap in juxtaposed relation to seal receiving surfaces on both the neck of the container and the closure cap. The shrinkable seal may be activated either prior to or substantially simultaneously with placement on the container neck so that the seal is formed against the seal receiving surfaces in relatively tight fitting relation therewith without removing the closure cap. The seal may be made of a time delayed shrinkable material with delayed shrinkage initiated by direct application of chemical, electrical or radiative means. Alternatively, the shrinkable seal may be activated after assembly onto the container neck by electromagnetic radiation, applied heat or particle beam deposition in either a direct or indirect manner. The seal receiving surfaces on the closure cap and container may comprise generally right cylindrical surfaces or three-dimensional surfaces.

The seal is thus formed against the seal receiving surfaces from externally of the outer closure cap without physically engaging the seal so that reforming of the seal or application of a similar seal after opening the container is highly difficult without equipment and/or techniques unavailable to the general public. With the seal so formed against the closure cap and container, any movement of the closure cap relative to the container irreparably damages or deforms the seal. The closure cap is made transparent in at least a portion thereof adjacent the seal to enable visual observation of the seal and thus visual detection of the damaged or deformed seal to ascertain tampering.

Accordingly, one of the primary objects of the present invention is to provide a novel tamper-proof closure arrangement for a container wherein any movement or tampering of the closure cap causes irreparable damage and deforming of a seal which may be readily visually observed through the closure cap.

A more particular object of the present invention is to provide a novel tamper-proof closure arrangement for a container and method for effecting same wherein a shrinkable seal is formed against selective seal receiving surfaces on both the container and closure cap while the seal is disposed within the closed closure cap and without removing the closure cap, the seal being such that movement of the closure cap relative to the container causes irreparable deforming of the seal which is visible through the closure cap.

A feature of one embodiment of the invention lies in the provision of a ring-like shrinkable seal which is placed over the neck of a container and received within an annular slot in a closure cap when secured on the container, the seal being of a character enabling shrinkage against three-dimensional surfaces on the cap and container while disposed internally of the closure cap and without physically contacting the ring, the closure cap having at least one transparent portion enabling visual observation of the seal whereby displacement or deforming of the seal through tampering is readily observable.

Further objects and advantages of the invention, together with the organization and manner of operation thereof, will become apparent from the following detailed description of the invention when taken in conjunction with the accompanying drawings wherein like reference numerals designate like elements through the several views.

DETAILED DESCRIPTION OF THE DRAWINGS

Figure 1:
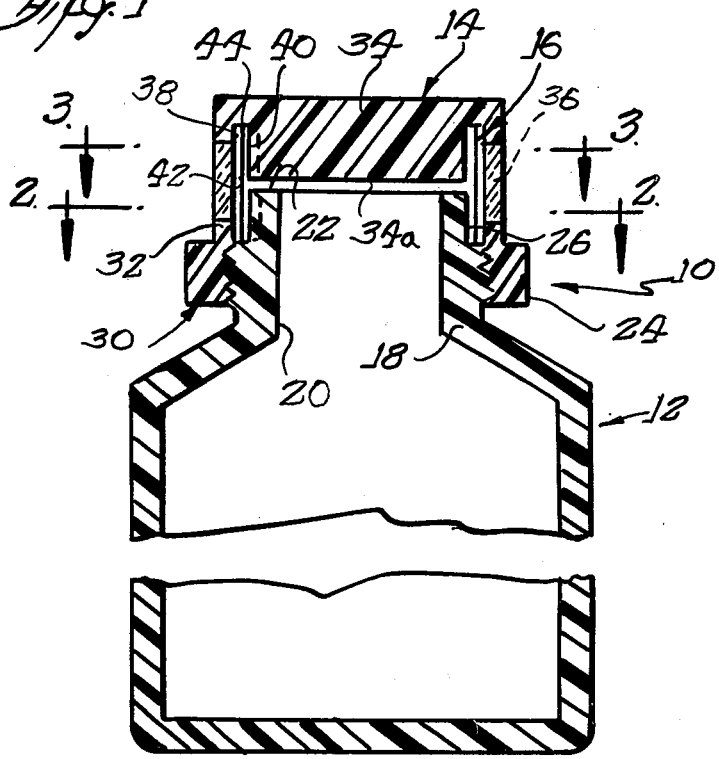
FIG. 1 is a foreshortened longitudinal sectional view of a container having a closure and tamper-proof seal applied thereon in accordance with the present invention.
Figure 3:
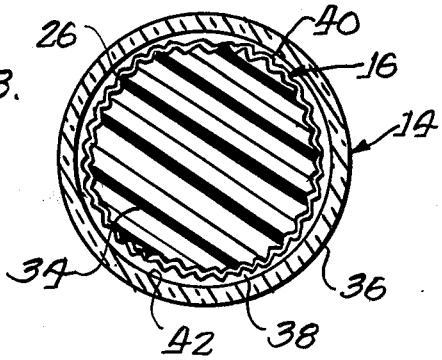
Figure 4:
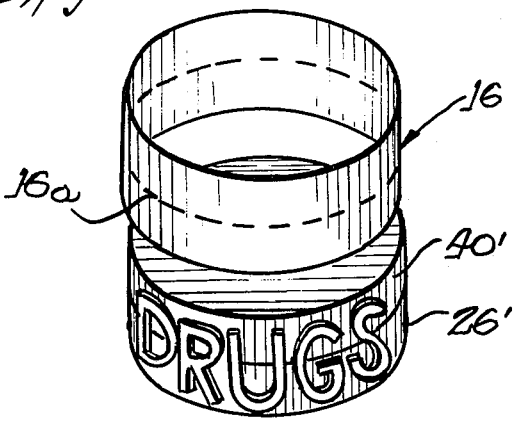
Figure 5:
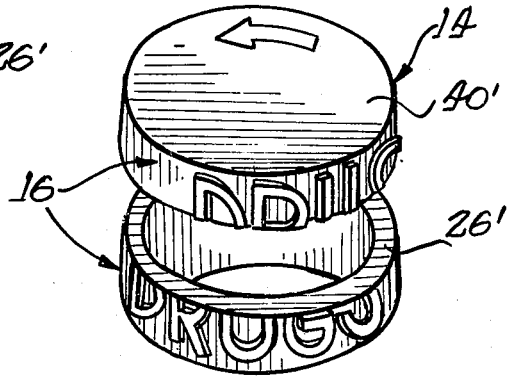

FIG. 3 is a transverse sectional view taken substantially along line 3—3 of FIG. 1, looking in the direction of the arrows; and FIGS. 4 and 5 are perspective views illustrating the manner in which a shrinkable ring-type seal is placed onto three-dimensional surfaces of the container and closure cap in accordance with the invention, and the manner in which the seal is irreparably damaged upon relative movement between the closure cap and container.

DESCRIPTION OF PREFERRED EMBODIMENT

Referring now to the drawing, and in particular to FIG. 1, a container having a tamper-proof closure arrangement thereon in accordance with the present invention is indicated generally at 10. Very generally the container and closure arrangement 10 includes a container, indicated generally at 12, on which is releasibly mounted a closure cap 14, and which cooperates with the closure cap to enable forming of a ring-like seal 16 against internal seal receiving surfaces on the closure cap and container while the closure cap is applied to the container and without physically contacting the seal. As will be described, the seal 16 is applied such that any movement of or tampering with the closure cap causes irreparable damage to the seal 16 which is visually observable through the closure cap.

The container 12 may be of substantially any desired configuration and may be made of any suitable material such as glass, plastic, ceramic, metal or other organic or inorganic compounds. If made of glass or plastic, the container may be transparent or opaque. The container includes an upper annular wall or neck portion 18 which defines a generally cylindrical access opening 20 communicating with the interior of the otherwise closed container and which intersects an upper end surface 22 of the annular wall or neck 18. In the illustrated embodiment, the annular neck wall 18 has an external right-hand thread 24 formed thereon which is spaced longitudinally below the upper end 22 so as to enable the formation of a three-dimensional surface 26 on the neck 18 which extends about the full outer periphery of the neck. The external thread 24 is adapted for releasible threaded connection with the closure cap 14 which, for this purpose, has an internal thread 30 formed internally of an annular wall or skirt 32 formed integral with or otherwise suitably secured to a circular cap end 34. The internal thread 30 is spaced longitudinally from the circular cap end 34 and is of a thread size to enable releasible connection to the external thread 24 on the container neck 18. The manner of releasibly mounting or attaching the closure cap 14 to the container neck 18 may take alternate forms, such as a bayonet-type connection and the like.

The closure cap 14 is preferably made of a transparent material such as a transparent plastic which enables visual observation through the closure cap from substantially any external angle. Alternatively, the closure cap may be made of an opaque material such as an opaque plastic or other suitable material which enables the provision of an annular transparent wall portion 36 formed intermediate the length of the annular wall or skirt 32. If desired, only an arcuate segmental portion of the annular wall 34 need be made transparent.

The closure cap end wall 34 is of sufficient longitudinal thickness to enable forming of an annular slot or groove 38 therein which is concentric with the longitudinal axis of the closure cap and is defined between concentric boundary surfaces 40 and 42. As illustrated in FIG. 1, the annular surface 42 is formed internally of the annular skirt wall 34 and extends from an annular slot base surface 44 longitudinally beyond an internal cap end surface **34*a* so that with the closure cap 14 mounted on the container neck 18, the annular slot 38 is established in part within the end cap 32 and in part between a portion of the peripheral surface 42 and the outer peripheral surface 26 on the container neck 18**.

Figure 2:
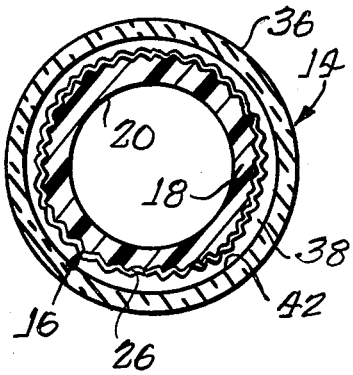
FIG. 2 is a transverse sectional view taken substantially along line 2—2 of FIG. 1, looking in the direction of the arrows.

In accordance with the embodiment of the invention illustrated in FIGS. 4 and 5, the peripheral surface 26 on the container neck 26 and the peripheral surface 40 on the closure cap are formed as generally annular seal receiving surfaces defined by three-dimensional surfaces having substantially equal mean diameters. The three-dimensional surface 40 is substantially contiguous with surface 26 when the closure cap is mounted on the container. Referring to FIGS. 2 and 3, the three-dimensional surfaces 26 and 40 may take the form of annular spur gear type teeth or serrations. The three-dimensional surfaces 26 and 40 may also take other alternative configurations such as illustrated, for example, in FIGS. 4 and 5 wherein right cylindrical seal receiving surfaces 26' and 40' represent surfaces on the container and closure cap corresponding to surfaces 26 and 40 in FIGS. 1—3. The right cylindrical surfaces 26' and 40' may each have three-dimensional letters or portions of letters formed or embossed thereon such that the letters form a word which may designate the contents of the corresponding container and which can be observed through the transparent closure cap, such as the word "DRUGS" shown in FIGS. 4 and 5. The surfaces 26' and 40' could also be embossed with a three-dimensional logo or the like.

The slot 38 is of sufficient size to receive the ring-like seal 16 therein when the closure cap is mounted on the container neck 10 as illustrated in FIG. 1. In the illustrated embodiment, the ring-like seal 16 is formed as a relatively thin tubular shrinkable ring or band having a circumference enabling the seal to be placed over the neck 18 of the container such that it rests on an annular shoulder surface **18*a* formed on the container neck. The seal 16 has a longitudinal length such that when the closure cap 14 is mounted on the container neck, the seal lies in juxtaposed relation to the seal receiving surfaces 26 and 40. The seal 16 may be made of a relatively thin shrinkable material characterized by its ability to be formed into relatively tight fitting relation against the surfaces 26 and 40** from externally of the closure cap and container without physically engaging the seal.

In accordance with the invention, the seal 16 may comprise a ring-like seal made from a heat shrinkable material adapted to be activated by chemical, electrical, or radiative processes and the like. The shrinkable material may be of the time delay type wherein the shrinkage characteristics of the seal may be activated during the packaging process immediately prior to or during placement of the sealing ring over the container neck 18 so as to lie in juxtaposed relation to the seal receiving surface 26. Thereafter, the closure cap 14 is assembled onto the container neck 18. The characteristics of the time delay shrinkable seal 16 are such that shrinking of the seal against the seal receiving surfaces 26 and 40 does not take place until the closure cap has been fully threaded onto the container neck 18.

It is also contemplated that the ring-like seal 16 could be made from a heat shrinkable material which is activated after assembling the seal and closure cap onto the neck of the container so that the seal lies in juxtaposed relation to the seal receiving surfaces 26 and 40. For example, the heat shrinkable seal and associated container and closure cap could be passed through electromagnetic radiation of sufficient magnitude to activate the heat shrinkable seal and effect its shrinkage against the seal receiving surfaces. Applied heat or particle beam depositon in either a direct or indirect manner could also be utilized to effect shrinking of the heat shrinkable seal 16. A feature of all of these techniques is that they enable activation of the shrinkage characteristics of the seal while assembled onto the container in underlying relation to the closure cap without physical access to the seal. Heat shrinkable seal material suitable for the seal 16 is commercially available from many sources such as Alpha Wire and Cable Company, Raychem Company and Electronized Chemical Corporation. One specific type of heat shrinkable plastic material suitable for the seal 16 is of the type covered by military specification MILI 23053/5 type 2.

In assembling the container 12, closure cap 14 and ring-like seal 16 as illustrated in FIG. 1, the seal 16 is first positioned on the upper end of the container neck 18 concentric with the seal receiving peripheral surface 26. As aforementioned, if the seal is made of a time-delay shrinkable material, it may be activated substantially simultaneously with placement on the container neck. The closure cap 14 is then placed over the seal 16 and threaded onto the external thread 24 on the container neck or otherwise suitably mounted thereon where alternative releasible connecting means are employed such as a bayonet-type connection or other closure cap connecting technique.

After assembling the closure cap 14 and seal 16 onto the upper neck portion of the container, the seal 16 is formed into intimate contacting relation with the seal receiving surfaces 26 and 40 by its previously activated shrinkage character or by subjecting the shrinkable seal to activating energy after the closure cap is applied to the container. By forming the closure cap 14 as a fully transparent member or by providing an annular portion of the skirt 32 as a transparent wall, the seal 16 may be readily visually observed through the closure cap.

With the closure cap and seal thus assembled onto the container, any attempt to tamper with or remove the closure cap, either through rotation or longitudinal movement relative to the container, will effect irreversible or irreparable damage or deformation to the seal 16 which is visible through the closure cap, thus providing an indication to a prospective purchaser that the container has been tampered with.

FIGS. 4 and 5 illustrate application of the seal 16 to seal receiving surfaces 26' and 40' which comprise right cylindrical surfaces having three-dimensional surfaces thereon in the form of embossed letters to comprise a selected word or logo. FIG. 4 illustrates placement of the seal 16 over the surfaces 26' and 40' so as to lie in juxtaposed relation thereto. FIG. 5 illustrates the effect of relative rotation between the closure cap surface 40' and the container surface 26' after forming the seal 16 intimately against the three-dimensional surfaces, such rotational movement serving to irreversibly shear the seal 16 or pull it away from the underlying three-dimensional surfaces, either of which would be visible through the closure cap. If desired, a line of weakness or score line, such as indicated at 16*a* in FIG. 4, may be formed circumferentially of seal 16 at approximately its longitudinal midpoint to facilitate shearing of the seal upon attempted removal of the closure cap.

Thus, in accordance with the present invention, a container and tamper-proof closure cap arrangement are provided wherein a visually observable seal is protected internally of the closure cap and is operative to indicate tampering with the container as by attempted removal of the associated closure cap. The seal and closure cap are operatively related to the container such that any attempt at removing the closure cap results in irreversible damage to the seal which may be visually observed through the associated closure cap, thus indicating to the prespective purchaser that the container has been tampered with. This advantageous result occurs even though various types of mechanical closures may be employed.

It will be appreciated that the described tubular seal 16 need not be made circular. It will also be understood that additional sealing means may be provided across the access opening in the illustrated container, such as a vacuum sealing membrane or a cork or other stopper inserted inside the container neck while still enabling employment of tamper-proof seals as aforedescribed.

By providing a tamper-proof seal which requires relatively sophisticated equipment not available to the general public, removal of the closure cap and associated seal and reapplication of a new seal after tampering with the container is most difficult and highly improbable.

While preferred embodiments of the present invention have been illustrated and described, it will be understood that changes and modifications may be made therein without departing from the invention in its broader aspects. Various features of the invention are defined in the following claims.

What is claimed is:

1. A container and closure cap arrangement comprising a container having a neck portion defining an access opening, a closure cap having an end portion and a circumferential skirt, said neck portion of said container and said annular skirt being mutually cooperable to enable releasable mounting of said closure cap on said neck portion, said closure cap and container neck portion having seal receiving surfaces formed thereon such that said three-dimensional surfaces are inaccessible from externally of said closure cap when mounted on said container neck portion, and a shrinkable ring-like seal member disposed between said closure cap and said container neck portion and being formed against said seal receiving surfaces in relatively tight fitting relation therewith such that relative movement between said closure cap and said container effects deformation of said seal, said closure cap having at least one transparent portion enabling visual observation of said seal member.

2. A container and closure cap arrangement as defined in claim 1 wherein said seal member comprises a generally tubular seal member made of a material enabling time delayed shrinkage of said seal member into said contacting relation with said seal receiving surfaces.

3. A container and closure cap arrangement as defined in claim 1 whrein said seal member is characterized as being adapted for shrinkage in response to application of thermal energy derived from the class of electromagnetic radiation, applied heat, or particle beam deposition in either a direct or indirect manner.

4. A container and closure cap arrangement as defined in claim 3 wherein said seal material is further characterized as being adapted for activation by chemical, electrical, or radiative energy.

5. A container and closure cap arrangement as defined in claim 1 wherein said seal member is tubular and has a line of weakness formed circumferentially thereof intermediate its ends.

6. A container and closure cap arrangement as defined in claim 2 wherein said closure cap has an annular slot formed therein adapted to receive said ring-like seal member therein when said closure cap is mounted on said container neck portion, said seal receiving surface on said closure cap defining a boundary surface of said slot and being adapted to have said seal member formed thereagainst when disposed within said slot.

7. A container and closure cap arrangement as defined in claim 1 wherein said closure cap is made of transparent material enabling full observation of said seal when said closure cap is mounted on said container.

8. A container and closure cap arrangement as defined in claim 1 wherein said seal receiving surfaces comprise three-dimensional surfaces.

9. A container and closure cap arrangement as defined in claim 8 wherein said three-dimensional surfaces are defined by serrated surfaces formed on said closure cap and on said container neck portion, said three-dimensional surfaces being adapted to have said seal member formed in intimate contacting relation therewith such that rotation of said closure cap relative to said container effects deformation of said seal member observable through said closure cap.

* * * * *